US011069501B2

(12) United States Patent
Wang et al.

(10) Patent No.: US 11,069,501 B2
(45) Date of Patent: Jul. 20, 2021

(54) MINIATURE SUPER SURFACE MOUNT FUSE AND MANUFACTURING METHOD THEREOF

(71) Applicant: AEM Components (Suzhou) Co., Ltd., Suzhou (CN)

(72) Inventors: Liwu Wang, San Diego, CA (US); Jun Li, Suzhou (CN); Xiangming Li, Suzhou (CN); Yonglin Yang, Suzhou (CN); Yuling Zhai, Suzhou (CN)

(73) Assignee: AEM COMPONENTS (SUZHOU) CO., LTD., Suzhou (CN)

( * ) Notice: Subject to any disclaimer, the term of this patent is extended or adjusted under 35 U.S.C. 154(b) by 81 days.

(21) Appl. No.: 16/499,721

(22) PCT Filed: Oct. 19, 2018

(86) PCT No.: PCT/CN2018/110931

§ 371 (c)(1),
(2) Date: Sep. 30, 2019

(87) PCT Pub. No.: WO2019/085768

PCT Pub. Date: May 9, 2019

(65) Prior Publication Data

US 2021/0057180 A1 Feb. 25, 2021

(30) Foreign Application Priority Data

Oct. 30, 2017 (CN) ..... 201711034212.1

(51) Int. Cl.
*H01H 85/041* (2006.01)
*H01H 69/02* (2006.01)
(Continued)

(52) U.S. Cl.
CPC ..... *H01H 85/0411* (2013.01); *H01H 69/022* (2013.01); *H01H 85/046* (2013.01);
(Continued)

(58) Field of Classification Search
CPC .. H01H 85/0411; H01H 85/046; H01H 85/06; H01H 85/08; H01H 85/11;
(Continued)

(56) References Cited

U.S. PATENT DOCUMENTS 4,118,684 A 10/1978 Mollenhoff
4,227,168 A * 10/1980 Knapp, Jr. ..... H01H 85/12 337/161

(Continued)

FOREIGN PATENT DOCUMENTS

CN 101004990 7/2007
CN 101807500 8/2010

(Continued)

OTHER PUBLICATIONS

Wang. Translation of CN 102568968A (Year: 2012).*

(Continued)

*Primary Examiner* — Jacob R Crum
(74) *Attorney, Agent, or Firm* — Hauptman Ham, LLP

(57) ABSTRACT

The present disclosure discloses a miniature super surface mount fuse, comprising: a fuse element provided with a low overload fusing point and at least two high breaking capacity fusing points connected in series with the low overload fusing point and respectively arranged on two sides of the low overload fusing point, at least two cavity plates provided with cavities, the low overload fusing point and the high breaking capacity fusing points being located at corresponding positions of the cavities; the present disclosure further provides a manufacturing method for a surface mount fuse; the miniature super surface mount fuse of the present disclosure can provide the protection for the civil consumer electronic circuit under various overload conditions without the occurrence of safety hazards such as smoking or cracking of the housing or explosion.

20 Claims, 5 Drawing Sheets

(51) Int. Cl.
*H01H 85/046* (2006.01)
*H01H 85/06* (2006.01)
*H01H 85/18* (2006.01)
*H01H 85/055* (2006.01)

(52) U.S. Cl.
CPC ..... *H01H 85/06* (2013.01); *H01H 85/18* (2013.01); *H01H 2085/0414* (2013.01); *H01H 2085/0555* (2013.01)

(58) Field of Classification Search
CPC ..... H01H 85/18; H01H 69/02; H01H 69/022; H01H 2085/0412; H01H 2085/0414; H01H 2085/0555
See application file for complete search history.

(56) References Cited

U.S. PATENT DOCUMENTS 5,673,014 A * 9/1997 Domanits ..... H01H 85/11 337/158
6,075,434 A * 6/2000 Rueckling ..... H01H 85/11 29/623
2004/0169578 A1* 9/2004 Jollenbeck ..... H01H 85/046 337/227
2014/0266564 A1* 9/2014 Enriquez ..... H01H 85/175 337/295
2017/0365433 A1* 12/2017 Hadler-Jacobsen ..... H01H 9/02

FOREIGN PATENT DOCUMENTS

| | | |
|---|---|---|
| CN | 201629184 | 11/2010 |
| CN | 101604602 | 5/2012 |
| CN | 102568968 | 7/2012 |
| CN | 103606497 | 2/2014 |
| CN | 104319206 | 1/2015 |
| CN | 204303736 | 4/2015 |
| CN | 104900460 | 9/2015 |
| CN | 205542672 | 8/2016 |
| CN | 205564694 | 9/2016 |
| CN | 106531587 | 3/2017 |
| CN | 107610988 | 1/2018 |
| CN | 207320046 | 5/2018 |

OTHER PUBLICATIONS

International search report dated Jan. 30, 2019 from corresponding application No. PCT/CN2018/110931.
Written Opinion dated Jan. 30, 2019 from corresponding application No. PCT/CN2018/110931.

* cited by examiner

MINIATURE SUPER SURFACE MOUNT FUSE AND MANUFACTURING METHOD THEREOF

RELATED APPLICATIONS

The present application is a National Phase of International Application Number PCT/CN2018/110931, filed Oct. 19, 2018, and claims the priority of China Application No. 201711034212.1, filed Oct. 30, 2017.

TECHNICAL FIELD OF THE INVENTION

The present disclosure relates to the field of electronic protection elements, in particular provides a miniature super surface mount fuse and a manufacturing method thereof.

BACKGROUND OF THE INVENTION

With the development of modern electronic technology, portable modern electronic devices have entered thousands of households from mobile phones, laptops and tablet computers, and these electronic devices require lithium-ion battery power, and the charger is a necessary weapon to achieve energy conversion—charging lithium-ion batteries. Recently, battery explosions, overheating, charger smoke and fire, and even fires have caused major safety accidents to occur frequently, and the safety design specifications for batteries and chargers are becoming higher and higher. As a secondary protection component, how the fuse plays a safe and reliable protection in the electronic circuit is closely related to the characteristics of the fuse. There are three main types of fuses for the protection of the alternating current input of the charger:

1) Plastic housing pin miniature fuses (small black bean/small red bean): Patent CN201629184 relates to a miniature fuse, which has the beneficial effect that by adding two parallel baffles beside the fuse element and higher than the fuse element, the generated arc directly hits the baffles instead of the housing when the fuse is disconnected, the arc is segmented by the interception of the baffles, the energy is instantaneously dispersed without forming a strong arc beam, and the miniature fuse housing will not be melted or washed away due to that the arc energy is dispersed by the baffles, helping to improve the safety of the fuse. However, such a miniature fuse is not sealed, and there is an arc leakage when breaking at a high voltage and a high current, and the safety breaking requirement under the extreme short circuit condition cannot be met. Patent CN101604602 provides a miniature fuse and a manufacturing method thereof to overcome the common shortcomings of the existing manufacturing technology, which more effectively stabilizes the fusion welding of the fuse element and the two-pin electrode, thereby improving the production yield, quality and safety of the miniature fuse. However, the production efficiency is still very low and cannot meet the quality requirements of lean production.

2) Surface mount ceramic tube fuses. The traditional ceramic tube fuse has a single wire wound fuse element characteristic, uses the copper wire electroplated with tin as the fuse element of the fuse, and has a poor consistency in the fusing and breaking characteristics of the product, and the quality stability of the product can not reach higher quality and high breaking characteristics requirements of the application market.

3) Epoxy plastic encapsulated ceramic tube lead fuse is based on the ceramic tube fuse, and in order to improve the sealing and breaking capacity, the outer surface of the ceramic tube fuse body (the ceramic tube plus copper caps of two ends) is coated with insulating epoxy resin material, and the terminal electrodes are led out by means of leads. Although fillers are used in conventional ceramic tube fuses or glass tube fuses, the fillers can only be filled as tightly as possible by vibration, and cannot be filled in the tube orifice, which has an effect on high breaking. Although such fuse can achieve a breaking capacity of 100 A/300 VAC, it can not meet a breaking requirement of 300 A/300 VAC.

Based on a global strategy, the design of the latest consumer chargers needs to meet the requirements of American and European safety regulations and other IEC standards, and the fuse products must meet the short-circuit breaking requirements under extreme conditions of 300 VAC (it can reach an instantaneous voltage of 600-900 Volts, a current of a few hundred amperes), and no jets, smoke, cracking, or burning of the board is allowed. At the same time, due to the trend of miniaturization of modern electronic equipment, the maximum size of miniature fuses must not exceed Size 4012 specified in the IEC standard. The fuses in the prior art use a tin-clad copper wound fuse element and a large amount of high-temperature soldering tin, and when breaking, all the fuse element and a large amount of soldering tin are melted and gasified to generate a huge pressure, causing the fuse to ignite and explode, which cannot meet the requirements for safe use.

SUMMARY OF THE INVENTION

In order to overcome the defects of the prior art, the present disclosure is intended to provide a miniature super surface mount fuse, which realizes the protection for circuits against low overload and high overload conditions.

A miniature super surface mount fuse, comprises:

a fuse element, the fuse element comprising at least one low overload fusing point for fusing at low overload and high breaking capacity fusing points for fusing at high overload, the high breaking capacity fusing points at least comprising a first fusing point and a second fusing point, the first fusing point, the low overload fusing point and the second fusing point being connected in series, one end of the low overload fusing point being connected with the first fusing point, and the other end of the low overload fusing point being connected with the second fusing point;

cavity plates, the cavity plates comprising a first cavity plate provided with a first cavity and a second cavity plate provided with a second cavity, the first cavity and the second cavity being closed up to form a cavity body, the low overload fusing point and the high breaking capacity fusing points being positioned within the cavity body;

substrates, the substrates comprising an upper substrate stacked above the cavity plates and a lower substrate stacked below the cavity plates;

a terminal electrode, the terminal electrode being provided on the substrates and/or on the cavity plates, and being electrically connected to the fuse element;

a filler, the filler being filled in the first cavity and the second cavity, and the filler comprising a powder having unequal particle sizes.

The surface mount fuse provided by the present disclosure, in particularly is a super fuse which can satisfy the protection for circuits against various kinds of overload conditions, without the occurrence of jets, smoke, cracking, and the like. The filler comprises, but not limited to, one or more selected from the group consisting of metal oxide powder, ceramic powder, quartz sand, silicon oxide powder, alumina powder, glass powders and metal hydroxide powder. The function of the filler is to absorb the energy of the arc by its sensible heat or latent heat, to provide a large condensed surface for the metal vapor, to reduce the thickness and continuity of the metal vapor condensing membrane, and to extinguish the arc.

Preferably, in order to ensure that the surface mount fuse of the present disclosure has sufficient rigidity and interlaminar press strength, the cross sectional areas of the cavities are between ½ and ⅔ of the cross sectional area of the entire surface mount fuse.

Preferably, the fuse element is made of a high-melting-point conductive metal material, and a surface of the low overload fusing point is coated by a low-melting-point metal layer. The high-melting-point conductive metal material comprises but not limited to copper, silver, and the like, and the low-melting-point metal comprises but not limited to tin.

Preferably, a surface of the fuse element is coated by an arc extinguishing material, to realize the functions such as cooling the melt, heat insulation, arc extinguishing, etc.

Further preferably, the surface mount fuse further comprises a fuse element plate positioned between the first cavity plate and the second cavity plate, and faces of the fuse element plate facing the first cavity and the second cavity are respectively attached with the fuse element.

Further preferably, the fuse element plate is a PCB board, and a thickness of the fuse element plate is 0.05-0.2 mm. The PCB board can be a flexible board, or a hard board.

Further preferably, the fuse element further comprises connecting portions for connecting the low overload fusing point and the high breaking capacity fusing points, and cross sectional areas of the high breaking capacity fusing points are less than cross sectional areas of the connecting portions.

Further preferably, two ends of the fuse element in a length direction thereof are respectively provided with a first end portion and a second end portion, a distance from the first fusing point to the first end portion is one-fifth to one-third of a distance between the first end portion and the second end portion, and a distance from the second fusing point to the second end portion is one-fifth to one-third of a distance between the first end portion and the second end portion.

Preferably, the filler has a particle size between 80 and 500 mesh.

Preferably, the filler having a particle size of 120-200 mesh is 30%-80% in all of the filler by volume.

Further preferably, the upper substrate, the first cavity plate, the fuse element, the second cavity plate and the lower substrate are pressed successively by an adhesive material from top to bottom.

Further preferably, the adhesive material is a pure adhesive film.

Further preferably, the adhesive material forms a plurality of adhesive layers, wherein, between the upper substrate, the first cavity plate, the fuse element, the second cavity plate and the lower substrate are respectively positioned an upper adhesive layer, a middle-upper adhesive layer, a middle-lower adhesive layer and a lower adhesive layer, and an upper portion of the first cavity is filled with the upper adhesive layer, and/or, a lower portion of the second cavity is filled with the lower adhesive layer.

Further preferably, the middle-upper adhesive layer and/or the middle-lower adhesive layer is hollowed out at a corresponding position of the cavity body.

Further preferably, the middle-upper adhesive layer and/or the middle-lower adhesive layer is filled with the adhesive material at a corresponding position of the cavity body, to eliminate the effect of the filler on the fuse element heat dissipation.

Another purpose of the present disclosure is to provide a manufacturing method of a miniature super surface mount fuse, comprising steps of:

S1) manufacturing a fuse element: coating a fuse element of metal material onto an insulating plate to form a fuse element plate, forming at least two narrowed regions on the fuse element as high breaking capacity fusing points, and coating a low-melting-point metal layer at a position near the middle of the fuse element to form a low overload fusing point; specifically, combining a fuse element of copper or copper alloy material with a PCB board by thin film technique to form a multilayer two-dimensional planar parallel fuse element plate, forming at least two narrowed regions on the fuse element as the high breaking capacity fusing points by means of pattern transfer, and electroplating a tin layer in the middle of the fuse element to form the low overload fusing point;

S2) manufacturing a substrate: disposing terminal electrodes on insulating plates to form substrates comprising upper substrate and lower substrate; specifically, etching a copper-clad circuit board to remove copper foil to form the substrates comprising upper substrate and lower substrate, and providing terminal electrode on the substrates;

S3) manufacturing cavity plates: opening cavities on insulating plates to form a first cavity plate having a first cavity and a second cavity plate having a second cavity; specifically, forming cavities on the insulating plate by milling or stamping or the like to form the first cavity plate having the first cavity and the second cavity plate having the second cavity;

S4) adhering the cavity plates and the fuse element: pre-adhering the first cavity plate, the fuse element plate and the second cavity plate successively via a pure adhesive film, the high breaking capacity fusing points and the low overload fusing point positioned within a cavity body formed by the first cavity and the second cavity;

S5) filling the first cavity plate: filling the first cavity with a filler, and pre-adhering the upper substrate and the first cavity plate utilizing a pure adhesive film; preferably, the filler comprises a powder having unequal particle sizes;

S6) filling the second cavity plate: filling the second cavity with a filler, and pre-adhering the lower substrate and the second cavity plate utilizing a pure adhesive film; preferably, the filler comprises a powder having unequal particle sizes;

S7) hot-pressing: pressing the pre-finished product; specifically, pressing the pre-finished product in a hot press;

S8) electroplating and cutting: opening an elongated slot on the substrate corresponding to the position of the terminal electrode, specifically, milling elongated slot on the substrate, extending the elongated slot at least to the lower substrate, electroplating an inner wall of the elongated slot with a conductive layer (a copper layer), and cutting the substrate to produce single miniature super surface mount fuses.

Further preferably, the fuse element is made from a conductive metal sheet by etching, milling, stamping, and the like.

Further preferably, in the steps S3-S4, coating a pure adhesive film on the insulating plate, penetrating through the insulating plate and a cavity of the pure adhesive film by milling, stamping and the like, forming a first cavity plate having a first cavity and a middle-upper adhesive layer as well as a second cavity plate having a second cavity and a middle-lower adhesive layer, hollowing out the middle-upper adhesive layer and the middle-lower adhesive layer at corresponding positions of the first cavity and the second cavity, and pre-adhering the first cavity plate, the fuse element plate and the second cavity plate successively via the middle-upper adhesive layer and the middle-lower adhesive layer.

The beneficial effects of the present disclosure are:

Compared with the prior art, on the one hand, by plating tin on the fuse element as a low overload fusing point, and disposing weak points of the structure on both sides of the tin plating point as high breaking capacity fusing points, under the condition of low overload, the low overload fusing point near or even at the fuse element hot spot has a lower melting point due to the alloy effect, and the fuse element melts at the low overload fusing point; in the extreme short-circuit condition (300 VAC/300 A), the high breaking capacity fusing points on both sides will fuse and the low overload fusing point remain intact, which not only realizes the control of the fusing of the fuse element at different positions under different conditions, but also avoids the occurrence of jet, cracking or even explosion of the fuse element caused by the gas generated by the fusing of the low melting point metal under the extreme conditions. On the other hand, the filler comprises powder having different particle sizes, so that the pore size between the particles of the filler is suitable and uniform, and the arc generated during the breaking can be instantaneously extinguished, and the thermal shock or radiation of the arc is avoided to cause smoke, cracking or carbonization of the fuse housing.

Further, the present disclosure adopts the PCB board and the thin film technology for the first time to prepare multi-layer fuse elements in parallel containing a controlled hot spot, which can conveniently realize the control of the shape, material combination, controlled hot spot distribution and distribution of fusing points under different overload conditions, reduce the stress on the fuse element itself, and effectively improve the arc extinguishing and lightning strike resistance of the fuse; the pure adhesive film has a characteristics of semi-curing (when the adhesive cure temperature is not reached but the melting temperature is reached, the adhesive after cooling can initially bond an upper surface and a lower surface together; at this time, the pressure is increased to make the temperature reach the curing temperature, and the adhesive is completely cured), in the process of hot pressing the fuse, the pure adhesive film is filled in the cavity due to the fluidity, and then presses the filler in the cavity tightly to prevent the gap between the filled fillers from being uneven and large to affect the arc extinguishing effect; the fuse element in the middle can change its own properties such as the shape, thickness and material according to requirements, to achieve product diversity.

The present disclosure provides a manufacturing method of a miniature super surface mount fuse, which adopts a modular design in the production process, can process the whole board, realizes large-scale production, and greatly improves production efficiency.

In the following, the present disclosure will be further explained combining the accompanying drawings and the embodiments.

Figure 1:
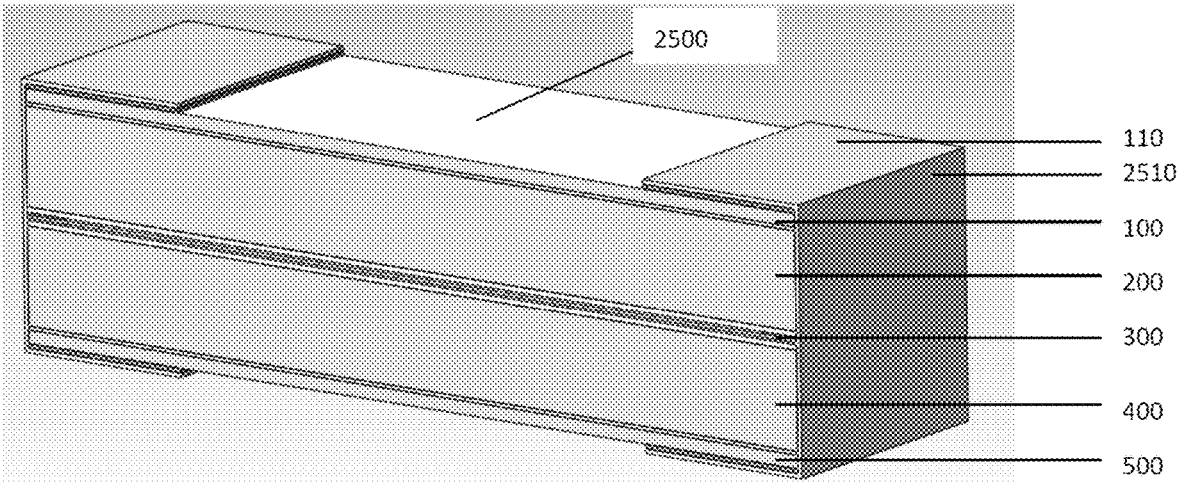
FIG. 1 is a schematic solid diagram of a miniature super surface mount fuse of Embodiment 1 of the present disclosure.
Figure 2:
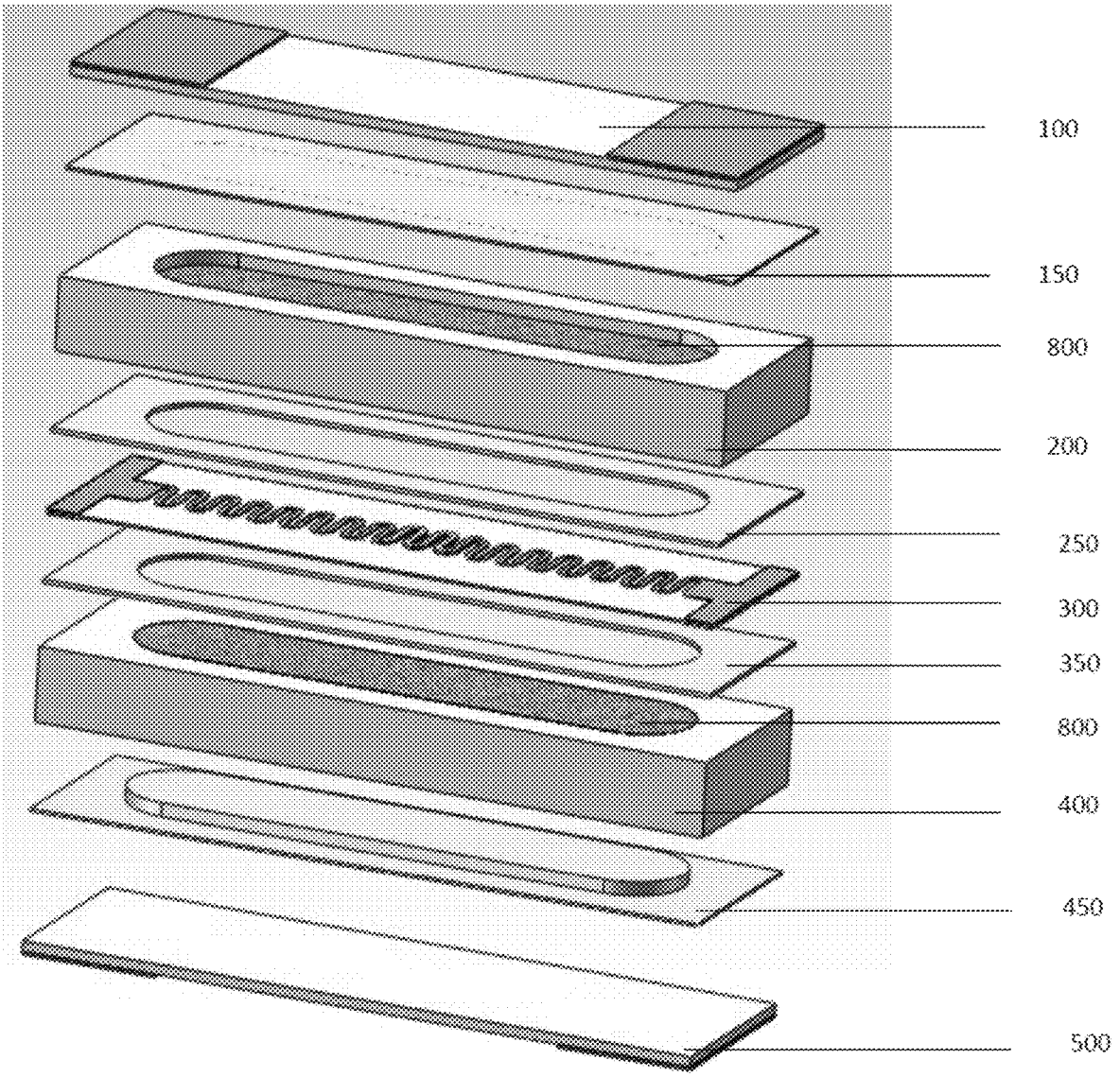
FIG. 2 is an exploded view of the layers of the miniature super surface mount fuse of Embodiment 1 of the present disclosure.
Figure 3:
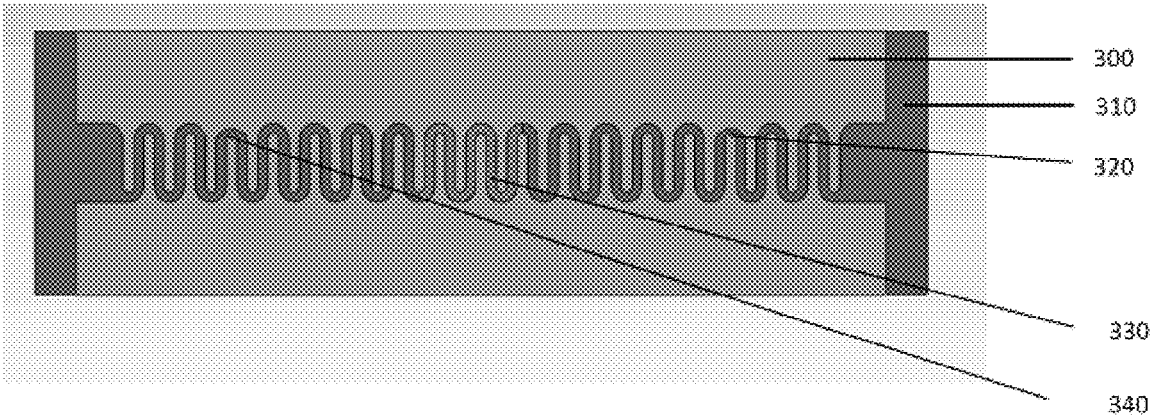
FIG. 3 is a top view of the fuse element plate of the miniature super surface mount fuse of Embodiment 1 of the present disclosure.
Figure 4:
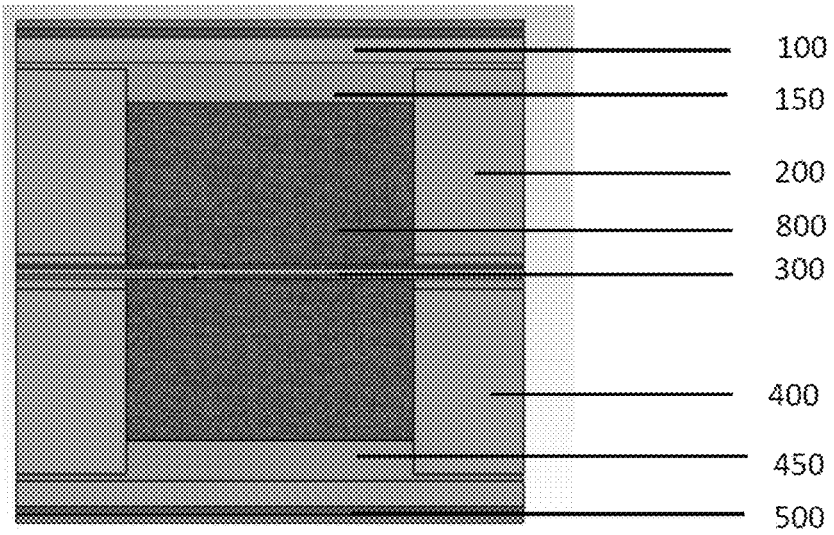
FIG. 4 is a schematic diagram of the longitudinal section structure of the miniature super surface mount fuse of Embodiment 1 of the present disclosure.

in the drawings: 2500—miniature super surface mount fuse; 100—upper substrate; 150—upper adhesive layer; 200—first cavity plate; 250—middle-upper adhesive layer; 300—fuse element plate; 320—first fusing point; 340—second fusing point; 330—low overload fusing point; 310—fuse element end portion; 350—middle-lower adhesive layer; 400—second cavity plate; 450—lower adhesive layer; 500—lower substrate; 800—filler; 110—terminal electrode; 2510—side terminal electrode.

DETAILED DESCRIPTION OF EXEMPLARY EMBODIMENTS

The present disclosure can be further clearly understood by the following specific embodiments of the present disclosure, but they are not intended to limit the present disclosure.

Embodiment 1

As shown in FIGS. 1-4, Embodiment 1 of the present disclosure provides a miniature super surface mount fuse comprising an upper substrate 100, a first cavity plate 200, a fuse element plate 300 made from a PCB board bonded with fuse elements on an upper surface and a lower surface thereof, a second cavity plate 400 and a lower substrate plate 500 pressed successively by a pure adhesive film from top to bottom, and the pure adhesive film comprises an upper adhesive layer 150, a middle-upper adhesive layer 250, a middle-lower adhesive layer 350 and a lower adhesive layer 450.

The fuse element comprises at least one low overload fusing point 330 for fusing at low overload and high breaking capacity fusing points for fusing at high overload, the high breaking capacity fusing points comprise at least a first fusing point 320 and a second fusing point 340, the first fusing point 320, the low overload fusing point 330 and the second fusing point 340 are connected in series, an end of the low overload fusing point 330 is connected with the first fusing point 320, the other end of the low overload fusing point 330 is connected with the second fusing point 340, and the first fusing point 320 and the second fusing point 340 are respectively connected with the fuse element end portions 310 on both sides. The fuse element end portions 310 comprise a first end portion and a second end portion respectively provided along a length direction of the fuse element, a distance from the first fusing point 320 to the first end portion is one-fifth to one-third of a distance between the two fuse element end portions 310, and a distance from the second fusing point 340 to the second end portion is one-fifth to one-third of a distance between the two fuse element end portions.

The first cavity plate 200 provided with a first cavity and the second cavity plate 400 provided with a second cavity form the cavity plates of the present disclosure, the first cavity and the second cavity are closed up to form a cavity body, the fuse element plate 300 is positioned within the cavity body, and the low overload fusing point 300, the first fusing point 320 and the second fusing point 340 are all positioned within the cavity body. The first cavity and the second cavity are filled with a filler 800, and the filler 800 comprises a powder of different particle sizes, and the powder has a particle size between 80 and 500 mesh, wherein the powder having a particle size of 120-200 mesh is 30%-80% in all of the powder by volume. The powder comprises, but not limited to, quartz sand, silicon oxide powder, alumina powder, and the like.

An upper surface of the upper substrate 100 and a lower surface of the lower substrate 500 are provided with terminal electrodes 110 for realizing the electric connection between the surface mount fuse of the present disclosure and a circuit, the electric connection between the terminal electrodes 110 and the fuse element is realized by the fuse element end portions 310 and a side terminal electrode 2510 at a side of the surface mount fuse.

The fuse element is made of copper foil, the surface of the low overload fusing point 330 is coated by a tin metal layer, and the fuse element further comprises connecting portions for connecting the low overload fusing point 330 and the high breaking capacity fusing points, and cross sectional areas of the high breaking capacity fusing points are less than cross sectional areas of the connecting portions. The surface of the fuse element is coated by an arc extinguishing material.

The adhesive material forms a plurality of adhesive layers, wherein, between the upper substrate 100, the first cavity plate 200, the fuse element, the second cavity plate 400 and the lower substrate 500 are respectively positioned an upper adhesive layer 150, a middle-upper adhesive layer 250, a middle-lower adhesive layer 350 and a lower adhesive layer 450, and an upper portion of the first cavity and a lower portion of the second cavity are respectively filled with the upper adhesive layer 150 and the lower adhesive layer 450, to press the filler 800 filled in the first cavity and the second cavity tightly.

The middle-upper adhesive layer 250 and the middle-lower adhesive layer 350 is hollowed out at a corresponding position of the cavity body, and at this time, the fuse element is in direct contact with the filler. The pure adhesive film on the middle-upper adhesive layer 250 and the middle-lower adhesive layer 350 is thinner and has worse fluidity than the pure adhesive film on the upper adhesive layer 150 and the lower adhesive layer 450, and mainly functions as an adhesive.

Figure 5:
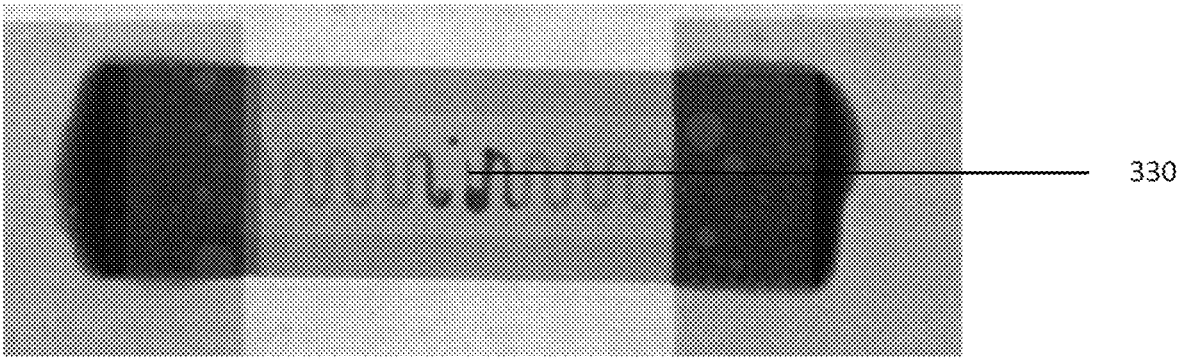
FIG. 5 is an X-RAY diagram of the miniature super surface mount fuse of Embodiment 1 of the present disclosure after suffering low overload conditions (two times of rated current)

As shown in FIG. 5, after the surface mount fuse of the present disclosure fuses under a low overload condition (two times of the rated current), only the low overload fusing point 330 fuses, and other portions of the fuse element remain intact. Due to the copper-tin alloy diffusion principle, the low overload fusing point 330 has a lower melting point than other portions of the fuse element, such that it can be broken at the low overload fusing point 330 at low currents.

Figure 6:
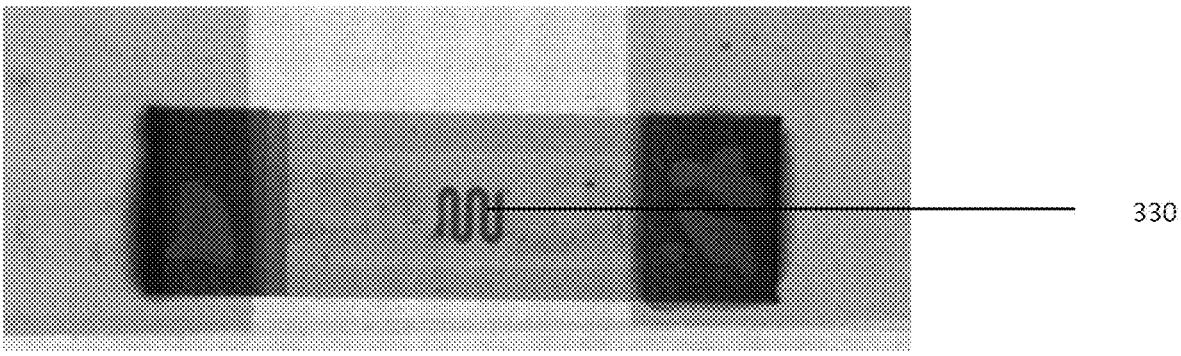
FIG. 6 is an X-RAY diagram of the miniature super surface mount fuse of Embodiment 1 of the present disclosure after suffering high overload conditions (300 VAC/300 A)

As shown in FIG. 6, after the surface mount fuse of the present disclosure fuses under a high overload condition (300 VAC/300 A), only the low overload fusing point 330 remains intact, and other portions of the fuse element made from high-melting-point metals have fused. At high current, due to the tin plated middle section, the hot melt value of the middle section is increased, and meanwhile, the high-breaking melting points 320/340 (line width weak points) are provided on both sides, which highlights the hot melt value of the tin plated middle section, therefore, it will be broken at both ends at high current, and the tin plated middle section will remain, as a result, the arc can be instantly cut off, and so that the fuse can withstand higher current.

Figure 7:
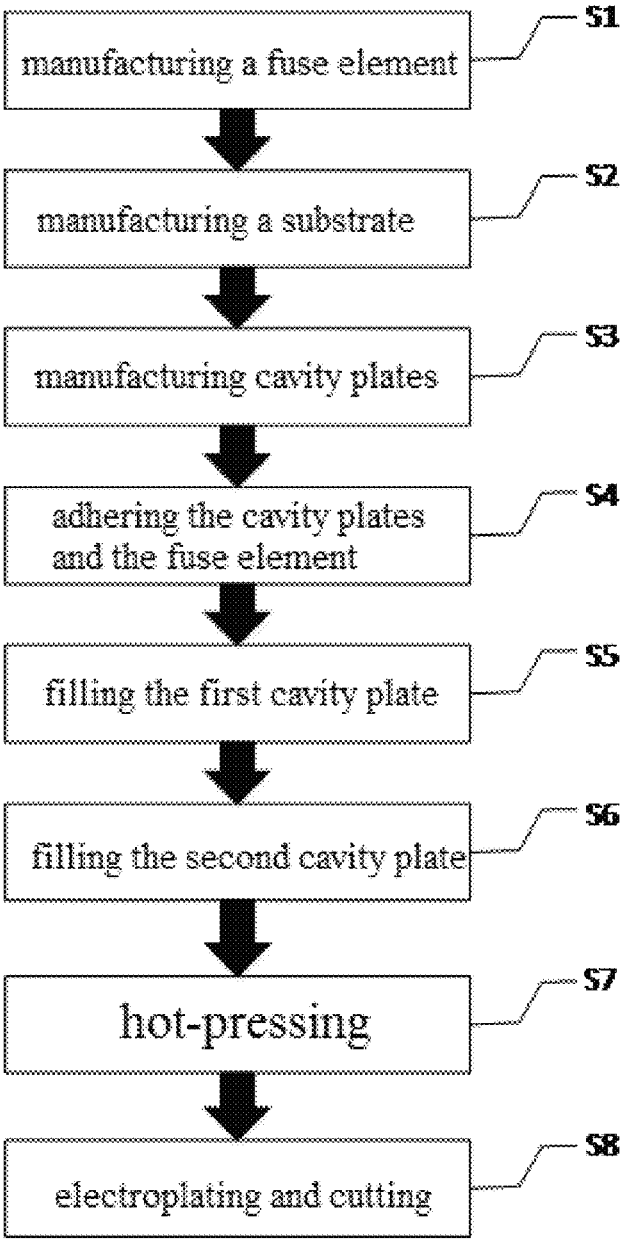
FIG. 7 is a schematic flow chart of a manufacturing method of the miniature super surface mount fuse of the present disclosure.
Figure 8:
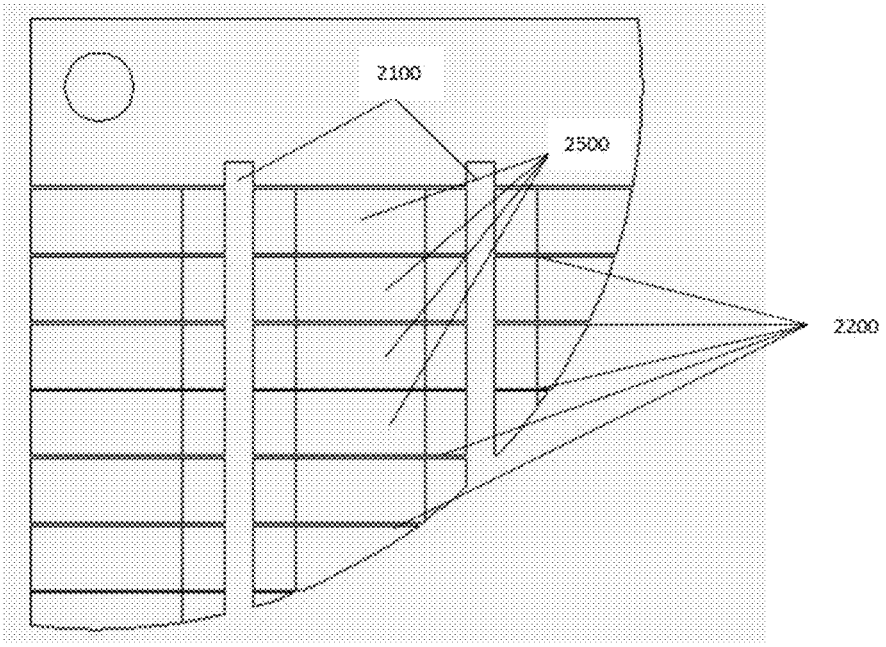
FIG. 8 is a schematic diagram of cutting the miniature super surface mount fuse of the present disclosure.

As shown in FIGS. 7-8, the manufacturing method of the surface mount fuse of the present disclosure comprises the following steps:

S1) manufacturing a fuse element: combining a fuse element of copper or copper alloy material with a PCB board by thin film technique to form a multilayer two-dimensional planar fuse elements in parallel plate 300, forming at least two narrowed regions on the fuse element as the high breaking capacity fusing points 320/340 by means of pattern transfer, and electroplating a tin layer in the middle of the fuse element to form the low overload fusing point 330;

S2) manufacturing a substrate: etching a copper-clad circuit board to remove copper foil to form the substrate comprising the upper substrate 100 and the lower substrate 500, and providing terminal electrodes on the substrate;

S3) manufacturing cavity plates: coating a pure adhesive film on the insulating plate, penetrating through the insulating plate and a cavity of the pure adhesive film by milling or stamping and the like, forming a first cavity plate 200 having a first cavity and a middle-upper adhesive layer 250 as well as a second cavity plate 400 having a second cavity and a middle-lower adhesive layer 350, and hollowing out the middle-upper adhesive layer 250 and the middle-lower adhesive layer 350 at corresponding positions of the first cavity and the second cavity;

S4) adhering the cavity plates and the fuse element: pre-adhering the first cavity plate 200, the fuse element plate 300 and the second cavity plate 400 successively via the middle-upper adhesive layer 250 and the middle-lower adhesive layer 350, disposing the high breaking capacity fusing points 320/340 and the low overload fusing point 330 within a cavity body formed by the first cavity and the second cavity;

S5) filling the first cavity plate: filling the first cavity with a filler 800, the filler comprises a powder having unequal particle sizes, and pre-adhering the upper substrate and the first cavity plate utilizing the pure adhesive film;

S6) filling the second cavity plate: filling the second cavity with a filler 800, the filler comprises a powder having unequal particle sizes, and pre-adhering the lower substrate and the second cavity plate utilizing the pure adhesive film, to produce a pre-finished product; S7) hot pressing: adding a steel plate to each of the upper and lower sides of the pre-finished product, and pressing the pre-finished product in a hot press;

S8) electroplating and cutting: milling an elongated slot on the substrate, extending the elongated slot at least to the lower substrate, electroplating an inner wall of the elongated slot with a copper layer to form the side terminal electrode 2510, and cutting the substrate to produce single miniature super surface mount fuses 2500.

Embodiment 2

Embodiment 2 of the present disclosure provides a miniature super surface mount fuse comprising an upper substrate 100, a first cavity plate 200, a fuse element plate 300 made from a PCB board bonded with fuse elements on an upper surface and a lower surface thereof, a second cavity plate 400 and a lower substrate plate 500 pressed successively by a pure adhesive film from top to bottom, and the pure adhesive film comprises an upper adhesive layer 150, a middle-upper adhesive layer 250, a middle-lower adhesive layer 350 and a lower adhesive layer 450.

The fuse element comprises at least one low overload fusing point 330 for fusing at low overload and a high breaking capacity fusing point for fusing at high overload, the high breaking capacity fusing point comprises at least a first fusing point 320 and a second fusing point 340, the first fusing point 320, the low overload fusing point 330 and the second fusing point 340 are connected in series, an end of the low overload fusing point 330 is connected with the first fusing point 320, the other end of the low overload fusing point 330 is connected with the second fusing point 340, and the first fusing point 320 and the second fusing point 340 are respectively connected with the fuse element end portions 310 on both sides. The fuse element end portions 310 comprise a first end portion and a second end portion respectively provided along a length direction of the fuse element, a distance from the first fusing point 320 to the first end portion is one-fifth to one-third of a distance between the two fuse element end portions 310, and a distance from the second fusing point 340 to the second end portion is one-fifth to one-third of a distance between the two fuse element end portions.

The first cavity plate 200 provided with a first cavity and the second cavity plate 400 provided with a second cavity form the cavity plates of the present disclosure, the first cavity and the second cavity are closed up to form a cavity body, the fuse element plate 300 is positioned within the cavity body, and the low overload fusing point 300, the first fusing point 320 and the second fusing point 340 are all positioned within the cavity body. The first cavity and the second cavity are filled with a filler 800, and the filler 800 comprises a powder of different particle sizes, and the filler has a particle size between 80 and 500 mesh, wherein the powder having a particle size of 120-200 mesh is 30%-80% in all of the powder by volume. The powder comprises, but not limited to, quartz sand, silicon oxide powder, alumina powder, and the like.

An upper surface of the upper substrate 100 and a lower surface of the lower substrate 500 are provided with terminal electrodes 110 for realizing the electric connection between the surface mount fuse of the present disclosure and a circuit, the electric connection between the terminal electrodes 110 and the fuse element is realized by the fuse element end portions 310 and a side terminal electrode 2510 at a side of the surface mount fuse.

The fuse element is made of copper foil, the surface of the low overload fusing point 330 is coated by a tin metal layer, and the fuse element further comprises connecting portions for connecting the low overload fusing point 330 and the high breaking capacity fusing points, and cross sectional areas of the high breaking capacity fusing points are less than cross sectional areas of the connecting portions. The surface of the fuse element is coated by an arc extinguishing material.

The adhesive material forms a plurality of adhesive layers, wherein, between the upper substrate 100, the first cavity plate 200, the fuse element, the second cavity plate 400 and the lower substrate 500 are respectively positioned an upper adhesive layer 150, a middle-upper adhesive layer 250, a middle-lower adhesive layer 350 and a lower adhesive layer 450, and an upper portion of the first cavity and a lower portion of the second cavity are respectively filled with the upper adhesive layer 150 and the lower adhesive layer 450, to press the filler 800 filled in the first cavity and the second cavity tightly.

Figure 9:
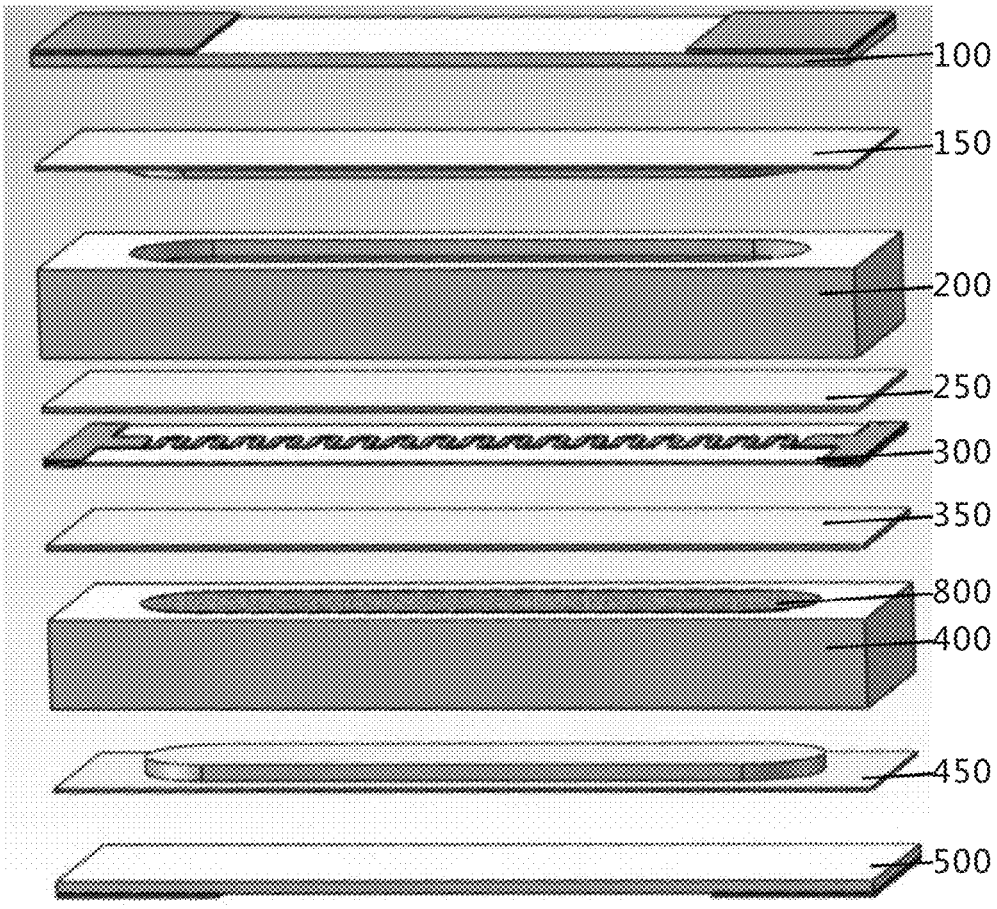
FIG. 9 is an exploded view of the layers of the miniature super surface mount fuse of Embodiment 2 of the present disclosure.

As shown in FIG. 9, the present embodiment differs from Embodiment 1 by that: the middle-upper adhesive layer 250 and the middle-lower adhesive layer 350 is filled with the pure adhesive film at a corresponding position of the cavity body. The pure adhesive film on the middle-upper adhesive layer 250 and the middle-lower adhesive layer 350 is thinner and has worse fluidity than the pure adhesive film on the upper adhesive layer 150 and the lower adhesive layer 450, and mainly functions as an adhesive.

As shown in FIGS. 7-8, the manufacturing method of the miniature super surface mount fuse of the present disclosure comprises the following steps:

S1) manufacturing a fuse element: combining a fuse element of copper or copper alloy material with a PCB board by thin film technique to form a multilayer two-dimensional planar parallel fuse element plate 300, forming at least two narrowed regions on the fuse element as the high breaking capacity fusing points 320/340 by means of pattern transfer, and electroplating a tin layer in the middle of the fuse element to form the low overload fusing point 330; S2) manufacturing a substrate: etching a copper-clad circuit board to remove copper foil to form the substrate comprising the upper substrate 100 and the lower substrate 500, and providing the terminal electrode on the substrate;

S3) manufacturing cavity plates: opening cavities on the insulating plate by milling, stamping, and the like, to form a first cavity plate 200 having a first cavity and a second cavity plate 400 having a second cavity;

S4) adhering the cavity plates and the fuse element: pre-adhering the first cavity plate 200, the fuse element plate 300 and the second cavity plate 400 successively via the pure adhesive film, disposing the high breaking capacity fusing points 320/340 and the low overload fusing point 330 within a cavity body formed by the first cavity and the second cavity;

S5) filling the first cavity plate: filling the first cavity with a filler 800, the filler comprises a powder having unequal particle sizes, and pre-adhering the upper substrate and the first cavity plate utilizing the pure adhesive film;

S6) filling the second cavity plate: filling the second cavity with a filler 800, the filler comprises a powder having unequal particle sizes, and pre-adhering the lower substrate and the second cavity plate utilizing the pure adhesive film, to produce a pre-finished product;

S7) hot pressing: adding a steel plate to each of the upper and lower sides of the pre-finished product, and pressing the pre-finished product in a hot press;

S8) electroplating and cutting: milling an elongated slot on the substrate, extending the elongated slot at least to the lower substrate, electroplating an inner wall of the elongated slot with a copper layer to form the side terminal electrode 2510, and cutting the substrate to produce single miniature super surface mount fuses 2500.

Embodiment 3

Another embodiment of the present disclosure provides a miniature super surface mount fuse comprising an upper substrate 100, a first cavity plate 200, a fuse element, a second cavity plate 400 and a lower substrate plate 500 pressed successively by a pure adhesive film from top to bottom, and the pure adhesive film comprises an upper adhesive layer 150, a middle-upper adhesive layer 250, a middle-lower adhesive layer 350 and a lower adhesive layer 450. The fuse element comprises at least one low overload fusing point 330 for fusing at low overload and a high breaking capacity fusing point for fusing at high overload, the high breaking capacity fusing point comprises at least a first fusing point 320 and a second fusing point 340, the first fusing point 320, the low overload fusing point 330 and the second fusing point 340 are connected in series, an end of the low overload fusing point 330 is connected with the first fusing point 320, the other end of the low overload fusing point 330 is connected with the second fusing point 340, and the first fusing point 320 and the second fusing point 340 are respectively connected with the fuse element end portions 310 on both sides. The fuse element end portions 310 comprise a first end portion and a second end portion respectively provided along a length direction of the fuse element, a distance from the first fusing point 320 to the first end portion is one-fifth to one-third of a distance between the two fuse element end portions 310, and a distance from the second fusing point 340 to the second end portion is one-fifth to one-third of a distance between the two fuse element end portions.

The first cavity plate 200 provided with a first cavity and the second cavity plate 400 provided with a second cavity form the cavity plates of the present disclosure, the first cavity and the second cavity are closed up to form a cavity body, the fuse element plate 300 is positioned within the cavity body, and the low overload fusing point 300, the first fusing point 320 and the second fusing point 340 are all positioned within the cavity body. The first cavity and the second cavity are filled with a filler 800, and the filler 800 comprises a powder of different particle sizes, and the filler has a particle size between 80 and 500 mesh, wherein the powder having a particle size of 120-200 mesh is 30%-80% in all of the powder by volume. The filler comprises, but not limited to, quartz sand, silicon oxide powder, alumina powder, and the like.

An upper surface of the upper substrate 100 and a lower surface of the lower substrate 500 are provided with terminal electrodes 110 for realizing the electric connection between the surface mount fuse of the present disclosure and a circuit, the electric connection between the terminal electrodes 110 and the fuse element is realized by the fuse element end portions 310 and a side terminal electrode 2510 at a side of the surface mount fuse.

The adhesive material forms a plurality of adhesive layers, wherein, between the upper substrate 100, the first cavity plate 200, the fuse element, the second cavity plate 400 and the lower substrate 500 are respectively positioned an upper adhesive layer 150, a middle-upper adhesive layer 250, a middle-lower adhesive layer 350 and a lower adhesive layer 450, and an upper portion of the first cavity and a lower portion of the second cavity are respectively filled with the upper adhesive layer 150 and the lower adhesive layer 450, to press the filler 800 filled in the first cavity and the second cavity tightly.

The middle-upper adhesive layer 250 and the middle-lower adhesive layer 350 is hollowed out at a corresponding position of the cavity body, and at this time, the fuse element is in direct contact with the filler. The pure adhesive film on the middle-upper adhesive layer 250 and the middle-lower adhesive layer 350 is thinner and has worse fluidity than the pure adhesive film on the upper adhesive layer 150 and the lower adhesive layer 450, and mainly functions as an adhesive.

Figure 10:
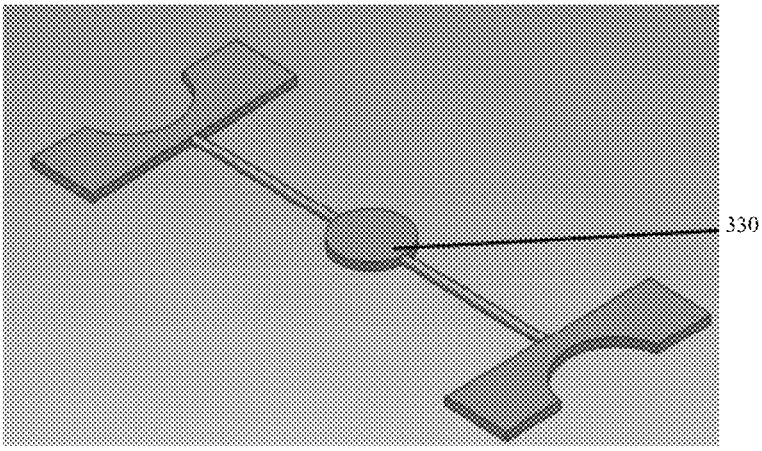
FIG. 10 is a schematic structure diagram of the fuse element of the miniature super surface mount fuse of Embodiment 3 of the present disclosure.

As shown in FIG. 10, unlike Embodiment 1, the fuse element in the present embodiment is formed from a metal sheet by mechanical processing such as etching, milling, and stamping. The fuse element can flexibly set its own properties such as the shape, thickness and material according to requirements, and the present disclosure will not provide the embodiment thereof. The fuse element further comprises connecting portions for connecting the low overload fusing point 330 and the high breaking capacity fusing points, and cross sectional areas of the high breaking capacity fusing points are less than cross sectional areas of the connecting portions.

As shown in FIGS. 7-8, the manufacturing method of the miniature super surface mount fuse of the present disclosure comprises the following steps:

S1) manufacturing a fuse element: forming the fuse element from a metal sheet by mechanical processing such as etching, milling, and stamping, forming at least two narrowed regions on the fuse element as the high breaking capacity fusing points 320/340, and electroplating a tin layer in the middle of the fuse element to form the low overload fusing point 330;

S2) manufacturing a substrate: etching a copper-clad circuit board to remove copper foil to form the substrate comprising the upper substrate 100 and the lower substrate 500, and providing the terminal electrode 110 on the substrate;

S3) manufacturing cavity plates: coating a pure adhesive film on the insulating plate, penetrating through the insulating plate and a cavity of the pure adhesive film by milling or stamping and the like, forming a first cavity plate 200 having a first cavity and a middle-upper adhesive layer 250 as well as a second cavity plate 400 having a second cavity and a middle-lower adhesive layer 350, and hollowing out the middle-upper adhesive layer 250 and the middle-lower adhesive layer 350 at corresponding positions of the first cavity and the second cavity;

S4) adhering the cavity plates and the fuse element: pre-adhering the first cavity plate 200, the fuse element and the second cavity plate 400 successively via the middle-upper adhesive layer 250 and the middle-lower adhesive layer 350, disposing the high breaking capacity fusing points 320/340 and the low overload fusing point 330 within a cavity body formed by the first cavity and the second cavity;

S5) filling the first cavity plate: filling the first cavity with a filler 800, the filler comprises a powder having unequal particle sizes, and pre-adhering the upper substrate 100 and the first cavity plate 200 utilizing the pure adhesive film;

S6) filling the second cavity plate: filling the second cavity with a filler 800, the filler comprises a powder having unequal particle sizes, and pre-adhering the lower substrate 500 and the second cavity plate 400 utilizing the pure adhesive film, to produce a pre-finished product;

S7) hot pressing: adding a steel plate to each of the upper and lower sides of the pre-finished product, and pressing the pre-finished product in a hot press;

S8) electroplating and cutting: milling an elongated slot on the substrate, extending the elongated slot at least to the lower substrate 500, electroplating an inner wall of the elongated slot with a copper layer to form the side terminal electrode 2510, and cutting the substrate to produce single miniature super surface mount fuses 2500.

Compared with the prior art, the super fuse provided by the present disclosure which can satisfy the protection for circuits against various kinds of overload conditions, and achieves the control of sectionally fusing the fuse element under various kinds of overload conditions, and meanwhile, the filler having different particle sizes is filled in the cavities, so that the pore size between the particles of the filler is suitable and uniform, and the arc generated during the breaking can be instantaneously extinguished, and the thermal shock or radiation of the arc is avoided to cause smoke, cracking or carbonization of the fuse housing.

The above is only the preferred embodiments of the present disclosure, and the scope of right of the present disclosure is not limited thereto, and the equivalent variations made by the scope of the present disclosure remain within the scope of the present disclosure.

What is claimed is:

1. A miniature super surface mount fuse, wherein, comprising:

a fuse element, the fuse element comprising at least one low overload fusing point for fusing at low overload and high breaking capacity fusing points for fusing at high overload, the high breaking capacity fusing points at least comprising a first fusing point and a second fusing point, the first fusing point, the low overload fusing point and the second fusing point being connected in series, one end of the low overload fusing point being connected with the first fusing point, and the other end of the low overload fusing point being connected with the second fusing point;

cavity plates, the cavity plates comprising a first cavity plate provided with a first cavity and a second cavity plate provided with a second cavity, the first cavity and the second cavity being closed up to form a cavity body, the low overload fusing point and the high breaking capacity fusing points being positioned within the cavity body;

substrates, the substrates comprising an upper substrate stacked above the cavity plates and a lower substrate stacked below the cavity plates;

a terminal electrode, the terminal electrode being provided on the substrates and/or on the cavity plates, and being electrically connected to the fuse element;

a filler, the filler being filled in the first cavity and the second cavity, and the filler comprising a powder having unequal particle sizes; the powder comprising but not limited to, one or more selected from the group consisting of metal oxides, ceramic, glass and metal hydroxides;

wherein, the fuse element is made of a high-melting-point conductive metal material, a surface of the low overload fusing point is coated by a low-melting-point metal layer, and cross sectional areas of the high breaking capacity fusing points are less than cross sectional areas of the low overload fusing point.

2. The miniature super surface mount fuse according to claim 1, wherein, the fuse element further comprises connecting portions for connecting the low overload fusing point and the high breaking capacity fusing points, and cross sectional areas of the high breaking capacity fusing points are less than cross sectional areas of the connecting portions.

3. The miniature super surface mount fuse according to claim 2, wherein, two ends of the fuse element in a length direction thereof are respectively provided with a first end portion and a second end portion, and a distance from the first fusing point to the first end portion is one-fifth to one-third of a distance between the first end portion and the second end portion.

4. The miniature super surface mount fuse according to claim 3, wherein, a distance from the second fusing point to the second end portion is one-fifth to one-third of a distance between the first end portion and the second end portion.

5. The miniature super surface mount fuse according to claim 1, wherein, the surface mount fuse further comprises a fuse element plate, the fuse element plate is positioned between the first cavity plate and the second cavity plate, and faces of the fuse element plate facing the first cavity and the second cavity are respectively attached with the fuse element.

6. The miniature super surface mount fuse according to claim 1, wherein, a surface of the fuse element is coated by an arc extinguishing material.

7. The miniature super surface mount fuse according to claim 1, wherein, the filler has a particle size between 80 and 500 mesh.

8. The miniature super surface mount fuse according to claim 7, wherein, a part of the filler having a particle size of 120-200 mesh is 30%-80% of all of the filler by volume.

9. A miniature super surface mount fuse, wherein, comprising:

a fuse element, the fuse element comprising at least one low overload fusing point for fusing at low overload and high breaking capacity fusing points for fusing at high overload, the high breaking capacity fusing points at least comprising a first fusing point and a second fusing point, the first fusing point, the low overload fusing point and the second fusing point being connected in series, one end of the low overload fusing point being connected with the first fusing point, and the other end of the low overload fusing point being connected with the second fusing point;

cavity plates, the cavity plates comprising a first cavity plate provided with a first cavity and a second cavity plate provided with a second cavity, the first cavity and the second cavity being closed up to form a cavity body, the low overload fusing point and the high breaking capacity fusing points being positioned within the cavity body;

substrates, the substrates comprising an upper substrate stacked above the cavity plates and a lower substrate stacked below the cavity plates;

a terminal electrode, the terminal electrode being provided on the substrates and/or on the cavity plates, and being electrically connected to the fuse element;

a filler, the filler being filled in the first cavity and the second cavity, and the filler comprising a powder having unequal particle sizes; the powder comprising but not limited to, one or more selected from the group consisting of metal oxides, ceramic, glass and metal hydroxides, wherein, the upper substrate, the first cavity plate, the fuse element, the second cavity plate and the lower substrate are pressed successively by an adhesive material from top to bottom, and the adhesive material forms a plurality of adhesive layers, wherein, between the upper substrate, the first cavity plate, the fuse element, the second cavity plate and the lower substrate are respectively positioned an upper adhesive layer, a middle-upper adhesive layer, a middle-lower adhesive layer and a lower adhesive layer, and an upper portion of the first cavity is filled with the upper adhesive layer.

10. The miniature super surface mount fuse according to claim 9, wherein, a lower portion of the second cavity is filled with the lower adhesive layer.

11. The miniature super surface mount fuse according to claim 9, wherein, the middle-upper adhesive layer is hollowed out or filled with the adhesive material at a corresponding position of the cavity body.

12. The miniature super surface mount fuse according to claim 9, wherein, the middle-lower adhesive layer is hollowed out or filled with the adhesive material at a corresponding position of the cavity body.

13. A manufacturing method of a miniature super surface mount fuse, wherein, the method comprises steps of:

coating a fuse element of metal material onto an insulating plate to form a fuse element plate, forming at least two narrowed regions on the fuse element as high breaking capacity fusing points, and coating a low-melting-point metal layer at a position near the middle of the fuse element to form a low overload fusing point;

disposing terminal electrodes on insulating plates to form substrates comprising an upper substrate and a lower substrate;

opening cavities on insulating plates to form a first cavity plate having a first cavity and a second cavity plate having a second cavity;

pre-adhering the first cavity plate, the fuse element plate and the second cavity plate successively via a pure adhesive film, the high breaking capacity fusing points and the low overload fusing point positioned within a cavity body formed by the first cavity and the second cavity;

filling the first cavity with a filler, and pre-adhering the upper substrate and the first cavity plate utilizing a pure adhesive film;

filling the second cavity with a filler, and pre-adhering the lower substrate and the second cavity plate utilizing a pure adhesive film, to produce a pre-finished product;

pressing the pre-finished product;

opening an elongated slot on the substrate corresponding to the position of the terminal electrode, extending the elongated slot at least to the lower substrate, electroplating an inner wall of the elongated slot with a conductive layer, and cutting the substrate to produce one miniature super surface mount fuses.

14. The manufacturing method of a miniature super surface mount fuse according to claim 13, wherein, the high breaking capacity fusing point is formed by pattern transfer.

15. The manufacturing method of a miniature super surface mount fuse according to claim 13, wherein, the substrate is made by etching a copper-clad circuit board to remove copper foil.

16. The manufacturing method of a miniature super surface mount fuse according to claim 13, wherein, the cavity body is made by milling or stamping, and the like.

17. The manufacturing method of a miniature super surface mount fuse according to claim 13, wherein, the filler comprises a powder having unequal particle sizes.

18. The manufacturing method of a miniature super surface mount fuse according to claim 13, wherein, the pre-finished product is pressed in a hot press.

19. The manufacturing method of a miniature super surface mount fuse according to claim 13, wherein, the fuse element is made from a conductive metal sheet by etching, milling, stamping, and the like.

20. The miniature super surface mount fuse according to claim 1, wherein, the upper substrate, the first cavity plate, the fuse element, the second cavity plate and the lower substrate are pressed successively by an adhesive material from top to bottom, and the adhesive material forms a plurality of adhesive layers, wherein, between the upper substrate, the first cavity plate, the fuse element, the second cavity plate and the lower substrate are respectively positioned an upper adhesive layer, a middle-upper adhesive layer, a middle-lower adhesive layer and a lower adhesive layer, and an upper portion of the first cavity is filled with the upper adhesive layer, and a lower portion of the second cavity is filled with the lower adhesive layer.

* * * * *